United States Patent [19]

De Waele

[11] Patent Number: 4,545,948

[45] Date of Patent: Oct. 8, 1985

[54] METHOD FOR ADJUSTING IN THE HEIGHT BUILDING BLOCKS AND SIMILAR

[75] Inventor: Gérard De Waele, Heldergem, Belgium

[73] Assignee: Hanota Holdings SA, Luxembourg, Luxembourg

[21] Appl. No.: 426,701

[22] Filed: Sep. 29, 1982

Related U.S. Application Data

[63] Continuation of Ser. No. 89,307, Oct. 30, 1979, abandoned.

[30] Foreign Application Priority Data

Oct. 31, 1978 [LU] Luxembourg ..... 80453

[51] Int. Cl.[4] ..... B28B 3/12; B28B 11/08

[52] U.S. Cl. ..... 264/162; 264/131; 264/133; 264/250; 264/251; 264/256; 264/259; 264/265

[58] Field of Search ..... 264/259, 131, 133, 250, 264/256, 251, 162, 265

[56] References Cited

U.S. PATENT DOCUMENTS

| | | | |
|---|---|---|---|
| 1,162,172 | 11/1915 | Jones | 264/259 |
| 1,262,308 | 4/1918 | Colt | 264/259 |
| 1,950,196 | 3/1934 | Slusher | 264/259 |
| 2,091,504 | 8/1937 | Gray | 264/259 |

FOREIGN PATENT DOCUMENTS

| | | | |
|---|---|---|---|
| 536968 | 2/1957 | Canada | 264/256 |
| 491561 | 9/1938 | United Kingdom . | |
| 615852 | 1/1949 | United Kingdom . | |
| 649808 | 1/1951 | United Kingdom . | |
| 861857 | 3/1961 | United Kingdom . | |
| 973275 | 10/1964 | United Kingdom . | |
| 1008870 | 11/1965 | United Kingdom . | |
| 1173112 | 12/1969 | United Kingdom . | |
| 1370509 | 10/1974 | United Kingdom . | |
| 1391621 | 4/1975 | United Kingdom . | |
| 1449993 | 9/1976 | United Kingdom . | |

*Primary Examiner*—Jan Silbaugh

*Attorney, Agent, or Firm*—Weiser & Stapler

[57] ABSTRACT

A method for adjusting blocks in the height which comprises laying over the top sides of the blocks an amount of a material which is hardenable and bindable thereon, with a height which is higher than the difference between said predetermined height and the actual height of the block under consideration, and levelling thereafter said material over said block sides before hardening thereof until the total block height formed by the sum of said block height and said material height, substantially corresponds to said predetermined height.

26 Claims, 9 Drawing Figures

METHOD FOR ADJUSTING IN THE HEIGHT BUILDING BLOCKS AND SIMILAR

This is a continuation of application Ser. No. 089,307, filed Oct. 30, 1979 now abandoned.

This invention has for object a method for adjusting in the height building blocks and similar, up to a predetermined height, notably hollow concrete blocks which are to be laid dry and freely upon one another and to be filled thereafter with a binder such as concrete.

Up to now it is substantially not possible even with very sophisticated presses, to obtain building blocks, notably concrete blocks the height of which does not vary over less than one millimeter. This is due among others to the quality and moistness of the raw materials used, such as sand, grit or expanded clay, varying very largely.

This is mostly a main drawback when manufacturing hollow concrete blocks to be laid dry, that is without mortar, upon one another as in such a case it is not possible to compensate for possible variations in the height by adjusting the mortar joint thickness.

A known method to obtain such accuracy in the height required lies in diamond-grinding the blocks after hardening thereof. Such a method does however require expensive equipment and a rather large workforce, with the result that said additional operation does substantially increase the costs of the end block.

One object of this invention lies in providing a method which allows obviating said drawbacks and which can be applied even to blocks which are manufactured on relatively unaccurate machines.

For this purpose the method according to the invention comprises laying over the top sides of the blocks an amount of a material which is hardenable and bindable thereon, with a height which is higher than the difference between said predetermined height and the actual height of the block under consideration, and levelling thereafter said material over said block sides before hardening thereof until the total block height formed by the sum of said block height and said material height, substantially corresponds to said predetermined height.

Advantageously as material which is hardenable and bindable on said blocks, use is made of a powdered product which hardens under the action of moisture, said powdered product being preferably comprised of cement or a cement-base product.

In a preferred embodiment of the invention, said material is levelled by means of a roller which is caused to roll without sliding, over said blocks at said predetermined height.

The invention also relates to a device for the working of the above-defined method.

Said device comprises a metering device for laying over the top sides of the blocks, an amount of material which is hardenable and bindable thereon, and a levelling means to level said material over the blocks to give thereto a total height which substantially corresponds to said predetermined height.

The levelling means advantageously comprises a levelling member which is mounted above a space where the blocks can be brought to flatten that material laid on said blocks by the metering device, and spacing means to retain the bottom surface of the blocks inside said space at a distance from said member which substantially corresponds to said predetermined height during the levelling of the material laid over said blocks.

In a preferred embodiment of the invention, the levelling member extends at a fixed height and raising means are provided below said member to move the blocks over which the material has been laid, upwards in the direction of said member, said spacing means being so arranged as to stop the raising when the bottom surface of said blocks lies at a distance from said levelling member which is substantially equal to said height.

Finally the invention further pertains to adjusted blocks obtained according to the above method or with said device.

Other details and features of the invention will stand out from the description given below by way of non limitative example and with reference to the accompanying drawings, in which.

In the various figures the same reference numerals pertain to similar elements.

Figure 1:
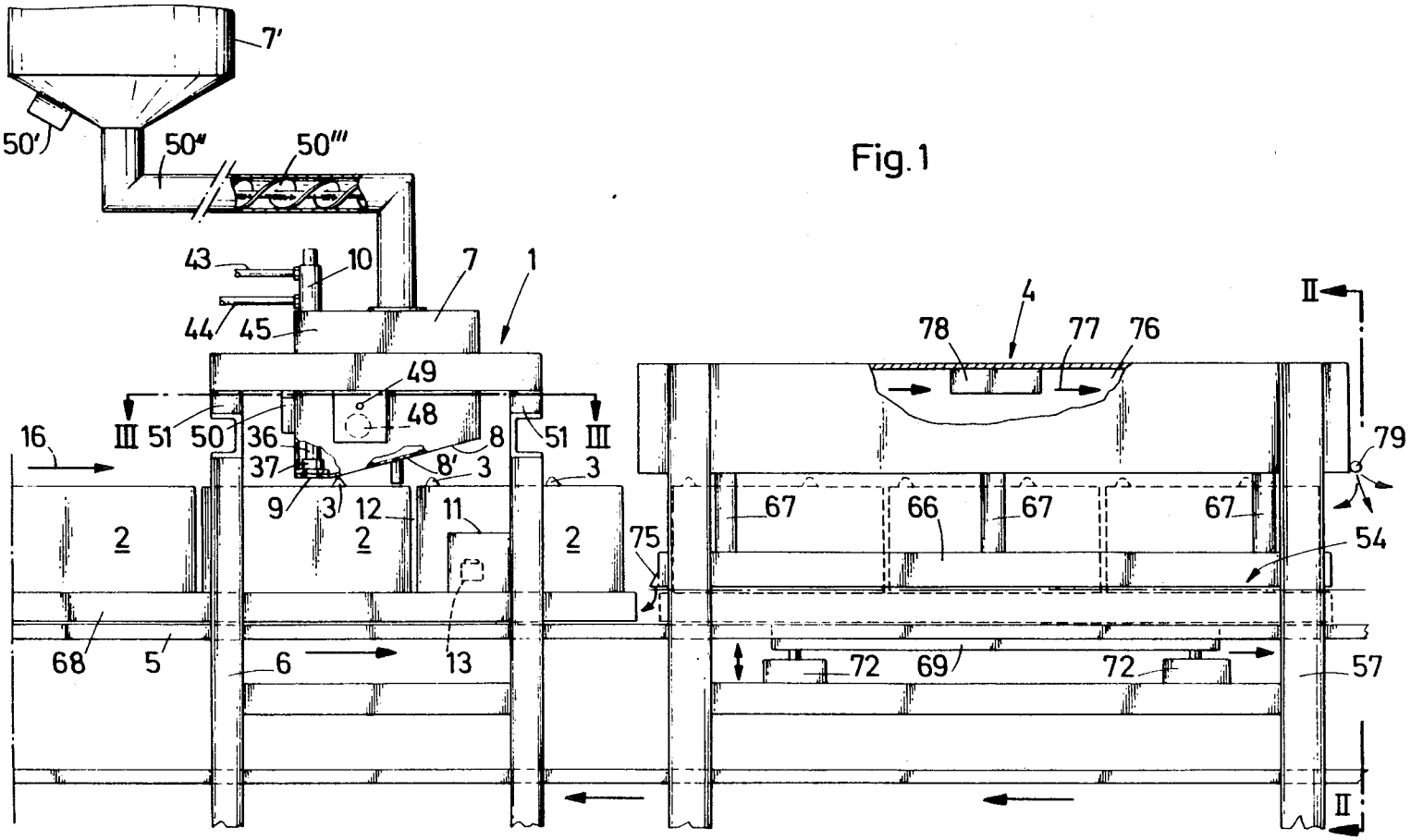
FIG. 1 is a diagrammatic side view of a particular embodiment of a device for adjusting the height of building blocks.

The invention has mainly for object the manufacture of concrete blocks and mainly blocks from light concrete on the basis of expanded clay, which have at least one hollow which extends through the blocks over the whole height thereof, and which can be assembled loosely to form depending channels inside which can be cast a binder such as concrete.

Consequently even if the invention is not limited to such blocks but does also apply for instance to plain blocks from concrete or not, to be cemented, the following example will however be limited essentially to such hollow blocks as defined above.

The invention generally comprises laying over the top sides of the blocks, an amount of material which is hardenable and bindable thereon, with a height which will be higher than the difference between a predetermined height and the actual height of the block to be adjusted, and levelling partly at least said material over said sides before hardening thereof until the total height of said block substantially corresponds to the predetermined height, said total height being formed by the sum of the actual height of said block and the height of said material amount.

As material hardenable and bindable on said blocks, use is preferably made of a product which has somewhat the same nature as some components of said blocks, such as a cement-based product and advantageously pure cement.

As the hardening of said material can then occur for instance under the action of moisture, said material should preferably be dry as it is laid over the blocks.

Advantageously said material is laid over the blocks as soon as the blocks leave the press, that is before the blocks are dry, to let said material harden and bind with said blocks partly at least under the action of the moisture contained inside the blocks themselves.

The material and notably the powdered product may in some cases be heated before being laid over the blocks, to be as dry as possible when the material falls on the blocks. It is of great importance to avoid any water condensing in the powdered product before said product is laid over the blocks. Consequently it might be useful in some other cases not to heat the powdered product to be distributed over the blocks.

Moreover use is advantageously made to level said material, of a member the surface of which contacting said material, has a temperature at least in the range of the temperature of the material which is laid over the blocks, to minimize the dangers of said material adhering to said contacting surface.

When required the material before laying same over the blocks, is heated to a temperature which is comprised between 30° and 60° C. and preferably to a temperature of about 40° C.

As regards the contacting surface of said member, said surface is preferably held at a temperature of at least 45° C. and preferably of about 70° to 80° C. when a danger of condensing is present.

In the case of hollow blocks to be assembled dry or loosely and inside which concrete is to be cast, so-called shuttering blocks, on the top edges of each block are formed at least four small heaps of said material which are so distributed as to form a stable basis for laying said blocks upon one another. Said heaps are then levelled to have said total height correspond substantially to the predetermined height.

In an usual embodiment of the method according to the invention, there are first shaped inside a mould blocks the height of which is lower than said predetermined height, over the blocks not yet hardened and still moist as they leave the mould is then laid an amount, for example of heap-shape, from said material, notably powdered cement, the height of which is higher than the difference between the predetermined height and the actual height of the block being adjusted, said material amount is levelled notably by means of a roller or cylinder, until said total block height as formed by the sum of the actual height thereof and the height of the material amount, substantially corresponds to said predetermined height and the blocks thus adjusted are subjected to drying and hardening.

The press inside which the blocks are shaped is so adjusted that the block height is at the most lower by 5 mm than said predetermined height, preferably lower by 2 mm, and over said blocks is laid an amount of said material with such a height that the total height of said block is higher by 5 mm at the most than said predetermined height.

Thus to form blocks the height of which is about 20 cm by means of a press allowing to obtain blocks with an accuracy of ±1 mm, it will be assumed for instance that the mean block height will be 19.9 cm and the predetermined height is adjusted at 20.1 cm.

To insure setting of the complete material amount laid over the blocks, said material is moistened, preferably after being levelled over said blocks.

For this purpose, a suitable solution lies in bringing the blocks provided with said material through a water mist.

To allow performing the method according to the invention continuously, the material is laid over the blocks while same are being moved with a substantially constant speed along a substantially horizontal direction.

In some cases depending on the accuracy of those presses being used to shape the blocks, the top surface of the blocks is brushed before laying thereon said material.

It would further be possible to provide an additional step before laying said material over the blocks, which comprises removing partly at least by means of a plate, the burrs formed on the top edges of said blocks.

There will now be given a detail description of a particular embodiment of a device for adjusting in the height building blocks and similar according to the above-defined method.

Said device which is shown in the accompanying figures, comprises essentially a metering device 1 to lay over the top block sides 2 an amount of material 3 which is hardenable and bindable thereon, and a levelling device 4 to level said material amount over the blocks to give thereto a total height which substantially corresponds to said predetermined height.

Said device is mounted at the outlet from a static press for the manufacturing of the blocks.

As said press does not form a part of the invention, is has not been shown in the figures.

The metering device 1 and the levelling means 4 are arranged in sequence and are synchronized with a conveyor 5 which feeds the blocks 2 from the press in sequence to the levelling means.

The metering device comprises a frame 6 which bears a hopper 7 with slanting bottom 8 to hold the powdered product to be laid over the blocks. Said hopper is provided in the bottom thereof with openings *9a, 9b, 9c, 9d,* etc. which each cooperate with a separate closure member 10 which allows to adjust the amount of product which passes through said openings. The bottom 8 of hopper 7 extends at a height which lies about 5 mm above that plane inside which moves the top surface of the blocks coming out of the press.

In such a way it is possible to form over the top side of the blocks, heaps 3 from the powdered material the height of which lies also in this range.

Means preferably electronic in nature, are provided to control the opening of the various openings depending on the position of the blocks below the hopper.

Moreover to be able to lay a suitable amount of powdered product over blocks with different widths, said means are so arranged as to control independently from one another, the opening of the various outlets or outlet groups according to said width and the block position below the hopper.

Figure 7:
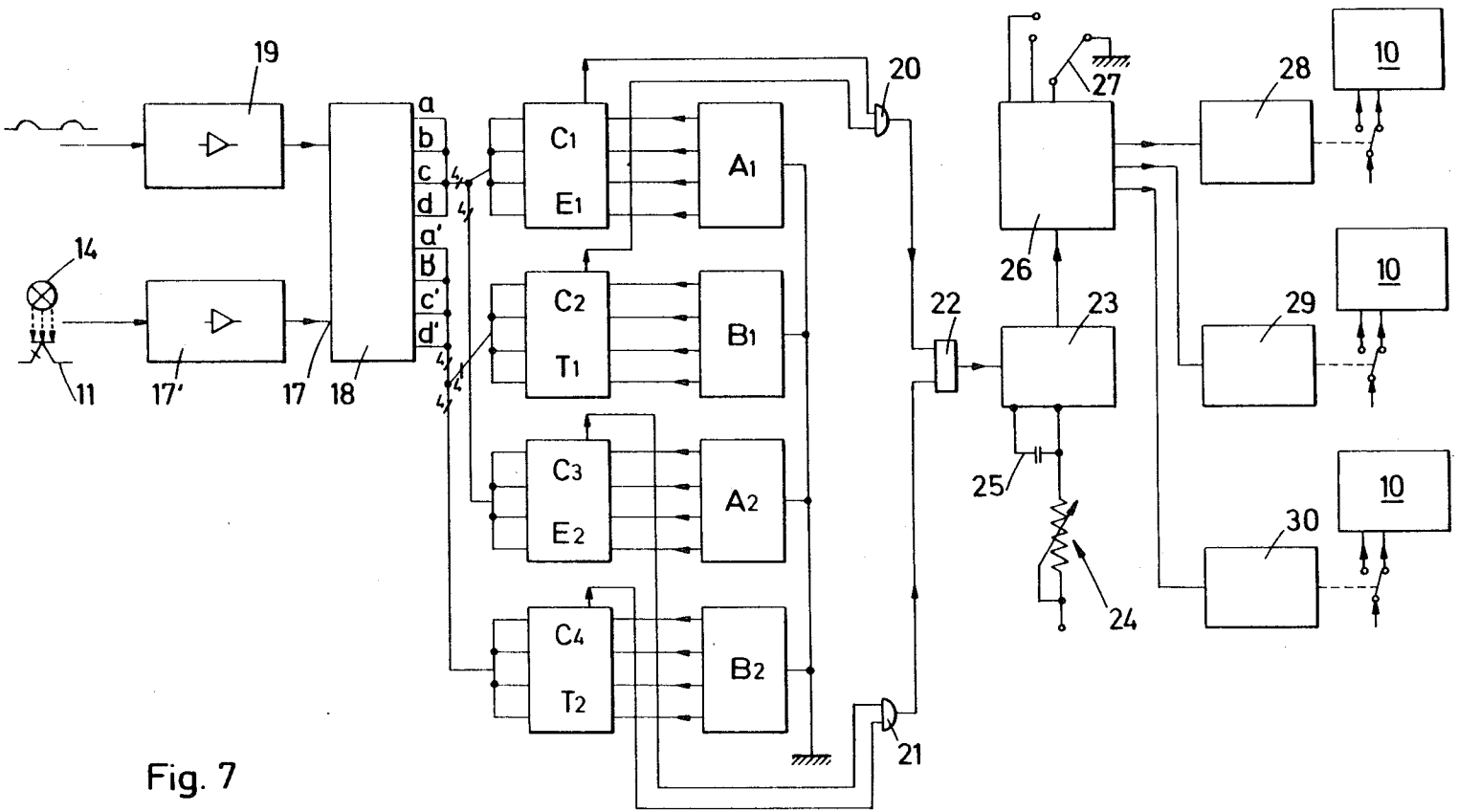
FIG. 7 is a block diagram of the essential part of the circuitry for the above embodiment of the invention.

FIG. 7 is a block diagram of a particular embodiment of electronic circuitry for controlling the opening of the various outlets according to the position of the blocks and the width thereof.

In this embodiment it is contemplated to lay over each side wall from blocks with a length of 39 cm, two heaps of powdered cement, the one heap 7 cm from that side facing the block front and another heap 21 cm from said side.

Said circuit comprises as sensor for the block position, a photo-transistor 11 which is mounted sidewise relative to space 12, below hopper 7, where the blocks move to receive the powdered product, for example inside a housing 13 fastened to frame 6.

It is important for said transistor which is very sensitive, not to be influenced by the dust which is formed when laying a powdered product over the blocks. For this purpose according to the invention, said photo-transistor is mounted at a level which is somewhat higher than the block bottom, preferably some 1.5 cm above said bottom. Moreover a tube which is now shown in the figures and which lies outside housing 13, opens therein and is directed along the viewing line of photo-transistor 11. Said housing is substantially tight and communicates with a pressurized air source to allow pressurizing said housing.

Figure 3:
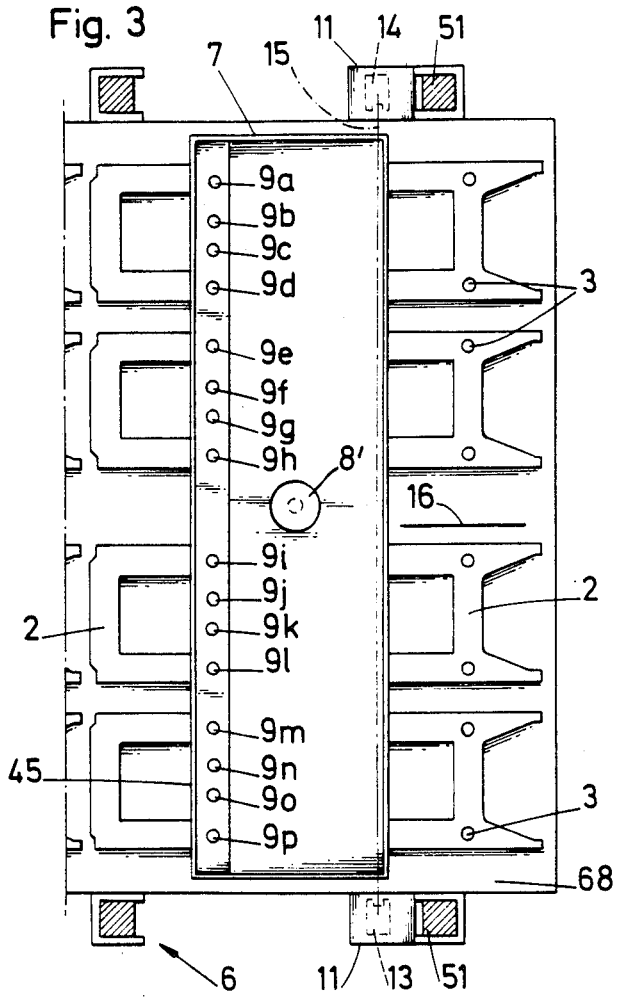
FIG. 3 is a view along line III—III in FIG. 1.

A light source which is shown diagrammatically in 14 in FIGS. 3 and 7, is provided on the other side of said space on a horizontal axis 15 that passes through said photo-transistor 11 and at right angle to the movement direction 16 of the blocks through the metering device 1.

The front side of a block is thus sensed by means of the cutting-off of the lighting of photo-transistor 11 by light source 14. Said photo-transistor is connected through a buffer 17' to the resetting input 17 of a two-decade pulse counter 18, in such a way that said counter is retained at zero as long as the photo-transistor is lighted and the counter can start counting as soon as the lighting of said photo-transistor 11 is cut-off due to the arrival of a block. The pulses to be counted are fed to counter 18 through a pulse-shaping circuit 19 which receives pulses at 50 Hz which are obtained from the mains.

The four outputs a, b, c, d of counter 18 correspond to the units in binary-coded decimal, while the four outputs 4*a', b', c', d'* correspond to the tens in binary-coded decimal.

Two circuits $A_1$ and $B_1$ each with four outputs, which are for instance comprised of rotating switches, give at the outputs thereof a bit configuration which shows in binary-coded decimal, the position required for the first heap. Two other circuits $A_2$ and $B_2$ which are respectively similar to circuits $A_1$ and $B_1$, give at the respective outlets thereof a bit configuration which shows in binary-coded decimal, the position required for the second heap.

The outputs a, b, c, d of counter 18 are connected to first inputs of a comparator $C_1E_1$ which is connected through the second inputs thereof to the outputs from circuit $A_1$. Said outputs a, b, c, d are also applied to the first inputs of a comparator $C_3E_2$ which is similar to $C_1E_1$, the second inputs of said comparator $C_3E_2$ being connected to the outputs of circuit A.

The outputs a', b', c', d' of counter 18 are connected to the first inputs of comparators $C_2T_1$ and $C_4T_2$ which are similar to comparator $C_1E_1$, the second inputs of said comparators $C_2T_1$ and $C_4T_2$ receiving respectively outputs from circuits $B_1$ and $B_2$. Each one of said comparators $C_1E_1$, $C_2T_1$, $C_3E_2$ and $C_4T_2$ generates a pulse at the output thereof when the bit configuration present at the first inputs thereof and the bit configuration present at the second inputs thereof are identical.

The outputs from $C_1E_1$ and $C_2T_1$ are connected to the inputs of a first AND gate 20. Consequently a pulse appears at the output from said AND gate 20 when the contents of counter 18 is equal to that number provided by circuits $A_1$ and $B_1$, said number showing the location of the first heap.

The outputs from comparators $C_3E_2$ and $C_4T_2$ are connected to the inputs of a second AND gate 21, a pulse thus being generated at the output thereof when the contents of counter 18 corresponds to the number provided by circuits $A_2$ and $B_2$, that is to the location required for the second heap.

The outputs of AND gates 20 and 21 are connected to the inputs of a circuit 22 which operates as OR gate the output of which is in turn connected to the setting input of a monostable multivibrator 23. The duration of the pulses generated by said multivibrator due to the energizing thereof is determined by a condenser 25 and the resistance of a potentiometer 24 which is used to adjust the duration of said pulses.

The pulses which appear at the output of monostable multivibrator 23 are applied through a matrix 26 the configuration of which is determined by the position of a selector switch 27, to power amplifiers 28, 29, 30 which each operate one closure member or closure member group 10. In such a way some closure members or closure member groups will be open for the duration of a pulse which appears at the output from monostable multivibrator 23 according to the position of selector switch 27.

In some cases mostly when the block rows follow rapidly one another, it might be useful to have a double sensing independently from photo-transistor 11. Such monitoring which has not been shown however, lies in acting upon the opening of said outlets after moving the blocks over a distance which corresponds to the length thereof.

In the particular embodiment of the device according to the invention as shown in the accompanying figures, the possibility has been provided to adjust the height of blocks 2 with a width of 14 cm, 19 cm and 28 cm.

Consequently the selector switch 27 has three possible positions for each block width.

When for instance the blocks as shown in FIG. 3 have a width of 28 cm, the opening of but those outlets 9*a*, 9*d*, 9*e*, 9*h*, 9*i*, 9*m* and 9*p* which lie above said block edges that pass below hopper 7, is controlled while in the case of blocks with a width of 14 cm, the opening of all of the outlets 9*a* to 9*p* is controlled simultaneously.

All of the outlets used for blocks with a width of 19 cm have not been shown in FIG. 3. Normally due to lack of space, it would be better to provide a second row of outlets for the blocks with a width of 19 cm.

Each closure member 10 comprises a double-action piston with hydraulic or pneumatic control, which is mounted above that corresponding outlet provided in the bottom of hopper 7.

Figure 5:
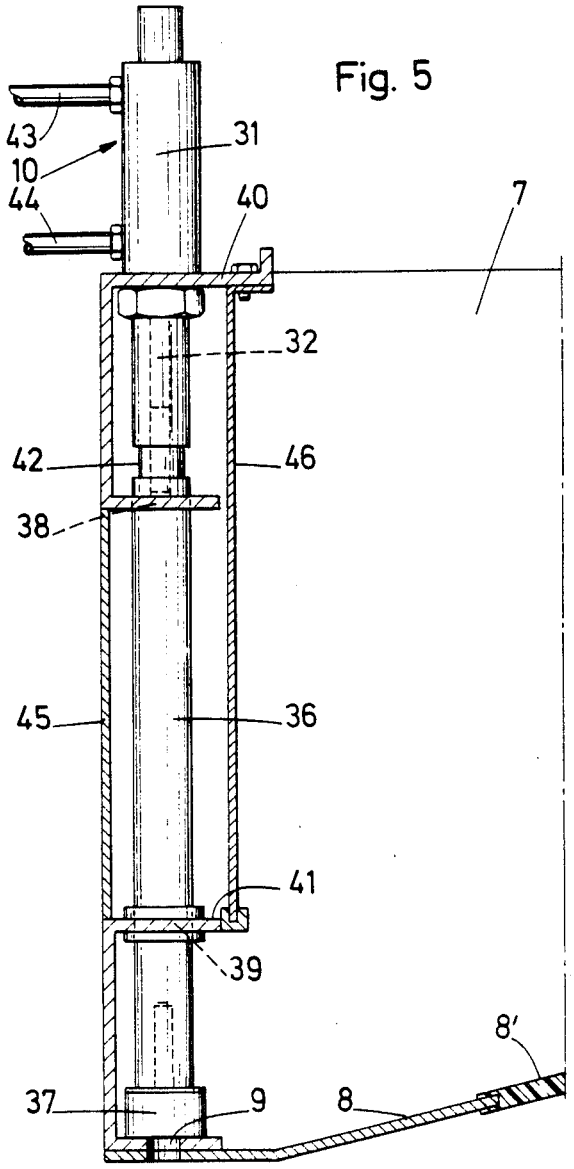
FIG. 5 is an elevation view of another detail of the embodiment as shown in FIG. 1.

A particular embodiment of such a closure member is shown in FIG. 5.

It is a double-acting air valve which comprises a cylinder 31 inside which slides a piston 32 the lower end of which is extended by a rod 36 from "Ertalon". Said rod is provided at the free end thereof, with a cylinder-like head 37 from hard rubber with a diameter larger than the one of outlet 9, to let said head bear on the edges of said outlet on the inner side of hopper 7.

Said rod is guided inside circular recesses 38 and 39 which are substantially co-axial with said outlet, which are provided in strengthening U-sections 40 and 41 of hopper 7.

Between piston 32 and rod 36 is mounted a rubber connector 42 to allow some axial play for said rod relative to the piston and thus to avoid any danger of the rod seizing inside recesses 38 and 39 during the lowering and raising thereof.

Cylinder 31 is supplied with pressurized air in 43 or 44 depending on the requirement of closing or opening the corresponding outlet 9.

Such valves are provided for each one of outlets 9a, 9b, etc. The valves are mounted in rows against surface 45 of hopper 7 and they may possibly by protected from powdered product 3 contained inside said hopper by a removable vertical baffle 46.

Heating means are provided to heat the material to be laid over the blocks. In the embodiment as shown in the figures, said means are provided inside hopper 7 and they comprise an electric resistor mounted inside a tube 48 which is insulated inside and extends cross-wise to the block movement direction, adjacent the hopper bottom. A thermostat which is arranged inside a tube 49 in parallel relationship with tube 48, allows retaining the temperature inside hopper 7 to a substantially constant value. To obtain on the one hand a substantially constant temperature within the complete mass of the product contained inside the hopper and on the other hand, a passage with a substantially constant flow rate of the powdery product through outlets 9a, 9b when same are opened, a vibrator 50 is mounted against the outer surface of hopper wall 45 to subject said product to a substantially uniform movement about tubes 48 and 49. To prevent the vibrations being transmitted to the whole frame 6, that portion thereof which bears hopper 7 is mounted on rubber pads 51.

It has moreover been noted in some cases that it might be useful to provide a silo 7' which is also subjected to the action of a vibrator 50' or similar, which is connected to hopper 7, for example through a pipe 50'' inside which rotates an Archimedean screw 50'''. A sensor for the amount of material inside hopper 7 is then mounted therein. In the embodiment as shown in FIG. 1, said sensor comprises a diaphragm 8' which is arranged in the bottom 8 of hopper 7, said diaphragm being distorted under the weight of the product and causing vibrator 50' to operate after a determined time delay, for instance after the passage of a determined number of blocks, so as to retain the product height at all times to a height of 2 to 10 cm.

Figure 2:
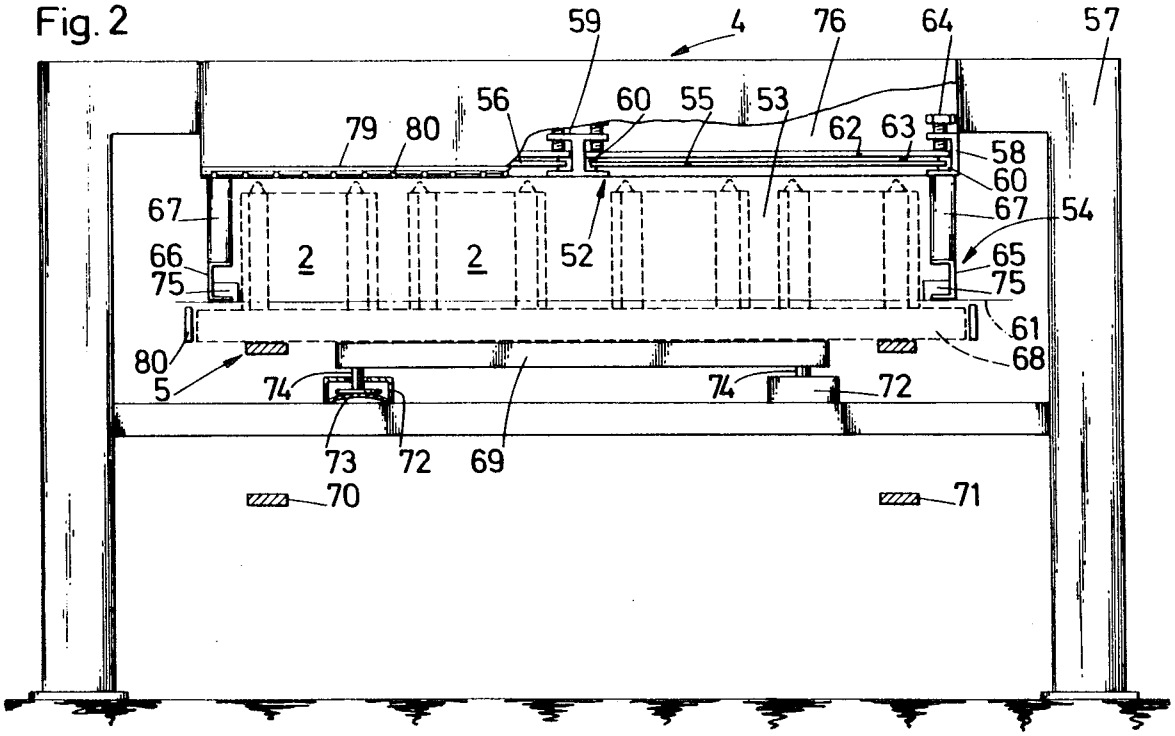
FIG. 2 is a front view of part of said embodiment along line II—II in FIG. 1.
Figure 4:
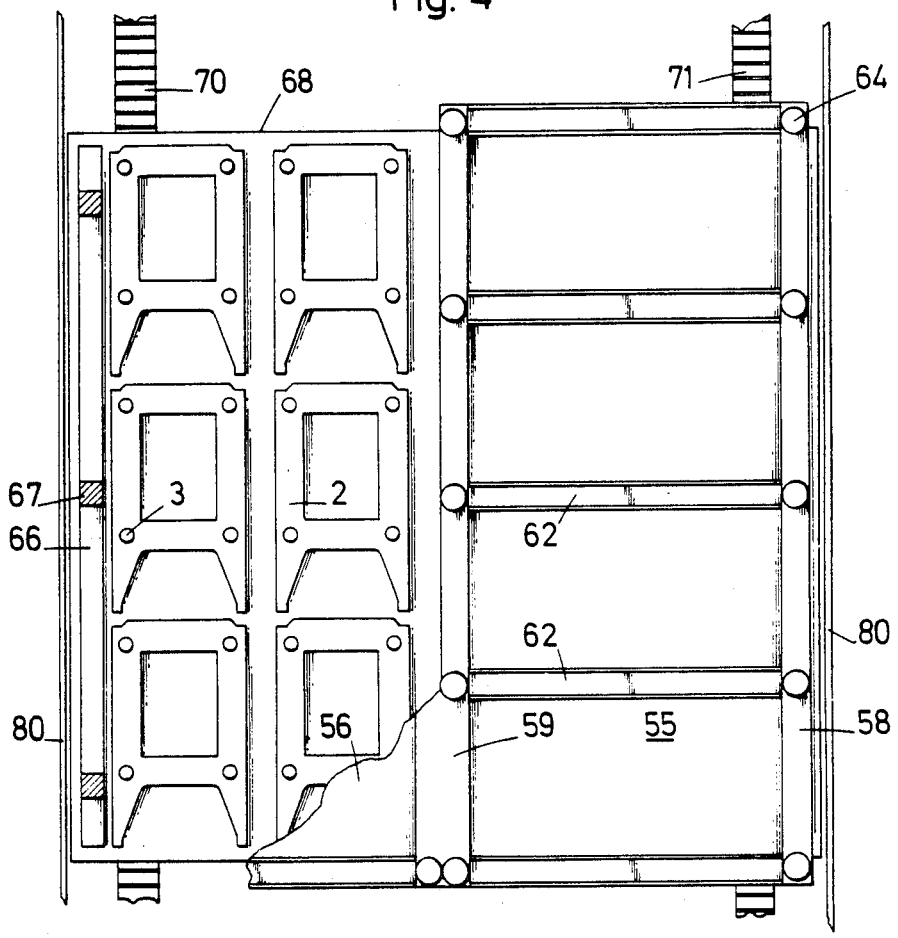
FIG. 4 is a detail view along line IV—IV in FIG. 1.

The levelling device as shown in FIGS. 1, 2 and 4, comprises a fixed frame 57 which bears a levelling member which is formed by a substantially horizontal flat platen 52 which is mounted in a stationary position above a space 53 where the blocks 2 may brought to flatten that material 3 lying thereon until the total height of said blocks substantially corresponds to a predetermined height.

Said predetermined height is adjusted by spacing means 54 which allow to retain during said flattening, the block bottom surface at a distance from said platen which is equal to said height.

In the embodiment shown in the figures, the platen 52 is formed by two relatively heavy glass plates 55 and 56 which lie in the same plane and bear with the outer lengthwise edge thereof on the one flange of a U section 58 and with the opposite lenghtwise edge thereof, on the lower flange of a center I section 59. Said edges are provided with a lead lining 60 to insure a close engagement in every point with the corresponding flange.

The inner surfaces of said flanges the plates bear on being slanted, the position thereof can be adjusted very accurately by sliding the plate edges over said surfaces.

Cross-members 62 which are also comprised of U sections, bear through a lead joint 63, on the upper surface of the glass plates 55 and 56 and insure the flatness thereof during the levelling of the powdery product 3 over the blocks 2. The ends of said cross-members are engaged between the flanges of sections 58 and 59 and retained in position by adjusting screws 64. The lower surfaces of plates 55 and 56 are coated with a film on the basis of ethylen polytetrafluoride, known under trade name "Teflon", to prevent any danger of the powdered product 3 adhering to said surface.

The blocks 2 are advanced from the press through the metering device 1 to the levelling device 4 on a tray 68 which moves in the direction of arrow 16, by means of conveyor 5. Said conveyor is formed by two endless chains 70 and 71 lying some distance away from one another. The top surface of said tray is absolutely flat.

The spacing members comprise two stringers 65 and 66 which are rigidly secured relative to glass plates 55 and 56 by means of uprights 67 on either side of that space 53 provided underneath plates 55 and 56. The lower side of the stringers will bear against tray 68 as said powdered product 3 is leveled over blocks 2.

Consequently it is of great importance that the bearing surfaces of said stringers lie at all times in a plane 61 which is in accurate parallel relationship with the lower surface of plates 55 and 56 and at a distance which corresponds to said predetermined height to which the blocks are to be adjusted.

Raising means comprising a rigid frame 69 mounted between both chains 70 and 71 of conveyor 5, allow to raise tray 68 up to the engagement with the bearing surfaces of said stringers 65 and 66.

For this purpose, air cylinders 72 with diaphragm 73 of that type normally used for short strokes, are provided in the four corners of frame 69, as the displacement in the height which said frame will undergo is generally at the most in the range from 5 to 8 mm. Such displacement should occur relatively smoothly and slowly to avoid any impact transferred to the blocks lying on tray 68 during the raising thereof. This is obtained by means of adjustable throttling needle-valves, not shown, in the circuit of the pressurized air acting on said diaphragms.

Diaphragm 73 acts on a piston 74 which has a rod the free end of which extends beyond the cylinder and is fastened to said frame 69. Said piston has the peculiarity of being somewhat swingable inside cylinder 72, in such a way that slight relative variations in the movement of different pistons inside the respective cylinders thereof, can be admitted during the raising of said tray. The pressure exerted by said pistons on the tray is such that said tray is strongly pressed against the bearing surfaces of stringers 65 and 66 during the levelling of the material laid over the blocks.

To prevent material particles lying between the bearing surface of the stringers and tray 68, a pressurized air-blowing head 75 is provided at each front end of the stringers. Said heads are directed towards tray 68 under an angle of about 30°, to remove possible particles from the tray location against which the stringers have to bear, to the outside of said tray, substantially along the same direction.

The supply of pressurized air to said blowing head is controlled by a switch, not shown, which is mounted in the path of tray 68, at the inlet to space 53 provided underneath plates 55 and 56.

To insure a substantially constant temperature of plates 55 and 56 above the room temperature, for example a temperature of about 70° C., an enclosure 76 is arranged thereabove, enclosure inside which is retained a continuous flowing of hot air as shown for instance by arrows 77, by means of an air heater 78. Said heater does comprise a thermostat and an electric resistor not shown.

A spraying apparatus comprising a distributor 79 provided with suitable nozzles 80 is mounted above the level of plates 55 and 56, against the back side of frame 57 of levelling means 4, substantially over the width of said plates, to form a water mist over the blocks when they leave the space 53 from said levelling means 4.

The operation of the embodiment of the adjusting device as shown in the figures and described above is as follows.

Blocks 2 formed inside moulds from a static press not shown in the figures, with a mean height of 19.9 cm, on trays 68 are advanced from said press directly after unmoulding, by means of conveyor 5 with a speed of about 40 cm/sec., through space 12 underneath hopper 7 towards levelling means 4. The tray stops within space 53 of the levelling means 4 when all of the block laying on said tray are correctly located below glass plates 55 and 56. Such stopping may for instance be obtained by means of a switch not shown in the figures, which is provided on the path of tray 68 in a suitable location relative to plates 55 and 56, said switch stopping the conveyor when tray 68 lies in said position.

At the moment where a row of blocks cuts off the rays from light source 14 towards photo-transistor 11, the resetting of the counter is inhibited and those pulses fed continuously to the counter are recorded. The counter then starts counting the pulses formed at the beginning of each block row sensed by the photo-transistor.

The pulses have been so selected as to have each pulse correspond approximately to a displacement over one centimeter of said blocks.

When the number of recorded pulses corresponds to the value set by rotating switches $A_1$ and $B_1$, a triggering pulse is obtained through gate 20 and gate 22 at the input to monostable vibrator 23.

Consequently to form a first material heap at 7 cm from the front edge of the blocks and a second heap at about 21 cm from said edge, the switch $A_1$ should be set to 7, as this corresponds to the units, and switch $B_1$ to 0, this corresponding to the tens.

In a similar way, switch $A_2$ should be set to 1 and switch $B_2$ to 2.

By means of the switching matrix 26 which is set by selector switch 27, a determined group of air valves 10 are operated and those outlets which correspond to the type of blocks to be adjusted in the height are opened.

The duration of the opening of said outlets is adjustable by means of potentiometer 24 which determines the duration of the output pulse from monostable vibrator 23.

It is to be noted that the electronics as shown in FIG. 7, are implemented according to the art of LOCMOS integrated circuits.

The main advantages of such technics lie in the stability within temperatures limits from −40° to +80° C., the protection against electrostatic voltages at the inputs and outputs and mostly the very large insensitiveness to noise pulses.

Moreover due to the relatively short spacing of about 8 mm, between two succeeding rows of blocks moving at a speed of about 40 cm.sec., it is essential to use a photo-transistor as photosensitive component rather than the usual photosensitive component known as LDR (light-dependent resistor) the inertia of which is too high.

Moreover as already stated above, it is possible to provide a double sensing independent from photo-transistor 11, which lies in opening the valves according to the movement of the blocks and not according to the sensing of a spacing between two succeeding block rows, in such a way that even if for some reason, the photo-transistor is unable to sense said spacing, after a displacement of the blocks over the length thereof, a signal will still be applied to pistons 10 sealing openings *9a*, *9b*, etc . . . .

The amount of product which is laid per unit of time over the blocks is determined on the one hand by the diameter of outlets *9a*, *9b*, etc . . . and on the other hand, by the magnitude of the vibration the hopper is subjected to.

It is of importance for some types of products such as cement, as used in this embodiment, that such product is not granulous or moist. For this reason any water condensing inside hopper 7 should be prevented.

The laying of the material over the blocks occurs while said blocks move in such a way that rather than laying small heaps over said blocks, it would be possible when desired, to form strips of some length which might even extend substantially over the whole block length.

Due to the use of double-acting pistons 10 driven by pressurized air, it is possible to obtain both a fast opening and a fast closing of outlets *9a*, *9b*, etc.

The tray 68 bearing blocks 2 passes with a continuous movement on conveyor 5, from the press to the levelling means 4 where it is stopped within space 53 under the action of an end switch not shown. Said switch controls a memory-timed relay in such a way that after the time set by said relay has elapsed, the tray 68 will go on moving on said conveyor 5.

Even if the conveyor might be left continuously moving, it is advantageous to stop the conveyor when the blocks enter levelling means 4, to prevent impacts on the tray as due to the lowering of raising frame 69, said tray is taken over by the conveyor and discharged from said levelling means.

Consequently the formation of a block tray in the press is advantageously synchronized with the adjusting in the height of the preceding block tray in the levelling means. The conveyor is thus stopped at this time and moves but when said block tray leaves the press to bring said tray inside the levelling means where the conveyor stops again. At the same time, the preceding block tray has thus been discharged from the levelling means.

The tray 68, as has it lies stationary inside space 53 of levelling means 4, is raised by the frame 69 to be engaged firmly against the bearing surfaces of stringers 65 and 66 from spacing means 54.

In such a position, the upper surface of the tray 68 and consequently also the lower surfaces of blocks 2 lie in that plane 61 which is accurately in parallel relationship with the lower surface of glass plates 55 and 56 and this at a distance which corresponds to the predetermined height to which the blocks have to be adjusted.

Due to the product laid over the blocks in the metering device being powdered, the heaps from such product are easily levelled or flattened until the total height of said blocks corresponds to said predetermined height.

Figure 6:
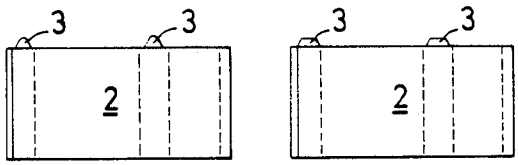
FIG. 6 is a part elevation view on a larger scale of building blocks which have been adjusted in the height according to the invention.

The difference between unlevelled heaps and levelled heaps according to the invention has been shown on a larger scale in FIG. 6.

In this case, said height has been adjusted to 20.1 cm.

As in this way the datum level comprises the upper surface of tray 68, it may be concluded that variations in the thickness of said tray have no influence on the accuracy of the blocks obtained.

To insure that the location where the tray engages stringers 65 and 66 be clean, the blowing heads 73 are operated and clean said tray location as it enters the space 53 in the levelling means. The blowing is stopped, for instance by means of an end relay not shown, at the moment where the tray has completely entered said space.

As the blocks entering the levelling means are still moist and not yet hardened, said blocks cannot withstand sudden impacts. For this reason, the tray 68 is raised by frame 69 with a slow and smooth motion under the action of pressurized air which flows, before entering cylinders 72, through a throttling needle-valve not shown to adjust the lifting speed of frame 69.

Due to the piston 74 being mounted with some play inside cylinder 72, said pistons act somewhat as hinging points with frame 69, in such a way that some angular displacement is allowed between the axes of the various pistons as the frame 69 is raised.

This results in speed differentials up to 50% being allowable between the four pistons.

While the lifting speed of frame 69 is adjusted by a throttling valve for each one of said cylinders, a single throttling valve is provided to adjust the lowering speed of said frame.

At the moment where a tray 68 bearing the blocks 2 leaves the levelling means, the spraying device 79 is started to produce a water mist above said blocks, said water mist bringing an additional amount of moisture to insure the setting and the complete hardening of the whole product amount laid over the blocks.

Said spraying device may for instance be started by a relay similar to the one controlling the blowing heads 75.

Figure 8:
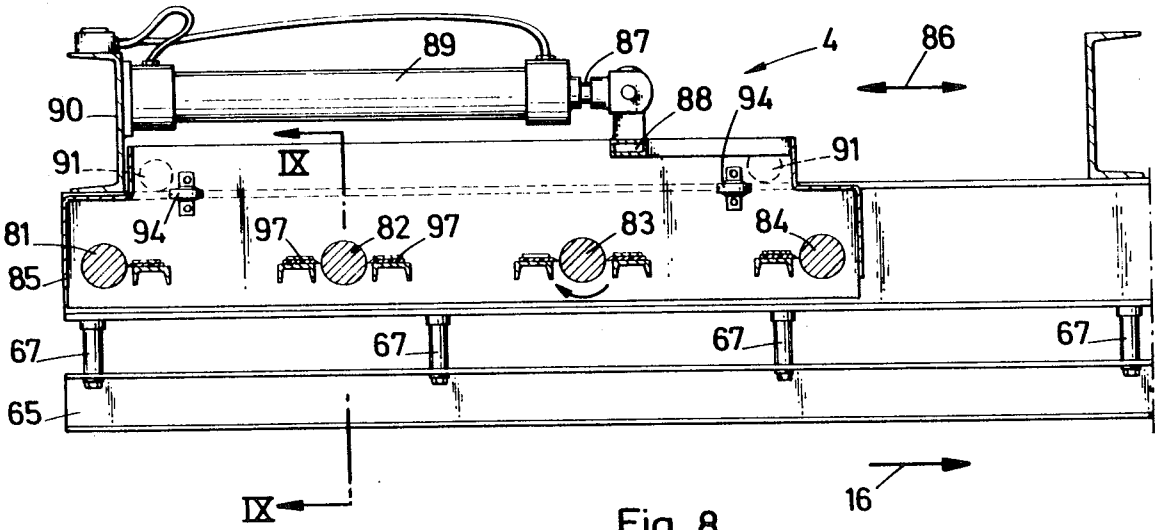
FIG. 8 is a diagrammatic side view with parts broken away, of another embodiment of part of the device for adjusting the height of building blocks.
Figure 9:
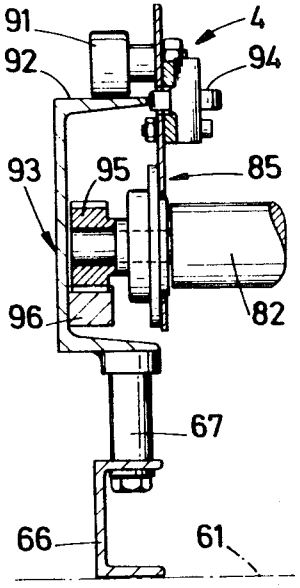
FIG. 9 is a part cross-section, on a larger scale, along line IX—IX in FIG. 8.

In an important variation of the method and equipment according to the invention shown in FIGS. 8 and 9, that material laid over the blocks is levelled by means of a roller which rolls without sliding, above the blocks at said predetermined height, in such a way that every point on the cylindrical surface thereof substantially describes a cycloid.

The levelling member of levelling means 4 thus comprises as shown in FIGS. 8 and 9, four identical rollers 81, 82, 83 and 84 which are mounted in a carriage 85. Said rollers are arranged some distance away from one another and the revolution axes thereof lie in parallel relationship with one another and at right angle to the block movement direction as shown by arrow 16, in a plane which lies substantially in parallel relationship with plane 61 in which lie the bearing surfaces of stringers 65 and 66, similar to the ones shown in FIGS. 1, 2 and 4.

Moreover, the spacing between the revolution axis plane and plane 61 is equal to the predetermined height of the blocks increased by the length of the roller radius, in such a way that the lower generatrix of each roller generates one and the same datum plane which extends at a distance from plane 61 which corresponds to said predetermined height, said height being adjusted by the spacing members 67.

The carriage 85 is moved alternately along the same direction as conveyor 5, as shown by arrows 86, by means of a double-acting piston 87 which is hinged to a cross-member 88 of the carriage and which slides inside a cylinder 89 which is hinged or secured to a fixed cross-member 90 of the levelling means 4. Said carriage is provided sidewise with small rollers 91 which rotate about a horizontal axis and run over the top trued-up surface 92 of a U section 93. Said surface does indeed have to lie in a plane which is substantially in parallel relationship with plane 61 to obtain the required accuracy in the block height.

Moreover guide rollers 94 rotating about a vertical axis and running against the edge of the top flange of section 93 allow insuring a movement of carriage 85 along a direction in parallel relationship therewith.

The one end at least of each cylinder is provided with a gear wheel 95 which cooperates with a rack 96 secured to the inner side of section 93, against the web thereof, said rack extending along the carriage movement direction. The pitch circle diameter of said gear wheels is equal to the diameter of rollers 81 to 84, in such a way that during the movement of carriage 85, every point on the cylindrical surface of said rollers generates a cycloid curve.

At least one scraping or wiping member 97 cooperates with the roller surface which engages the powdered product laid over the blocks. It is more particularly comprised of a strip from relatively flexible material which is continuously applied against the roller surface, at a height above said datum plane. In FIG. 8, rollers 81 and 84 cooperate with a single scraping member, while the other rollers cooperate with two scraping members which are diametrically opposed.

In the case where water condensing might form on rollers 81 to 84, heating means therefor might advantageously be provided.

The working of the levelling means as shown in FIGS. 8 and 9 is similar to the working of the levelling means shown in FIGS. 1, 2 and 4, with the single difference that to the levelling member in FIGS. 8 and 9 is imparted a horizontal alternating motion while the levelling member in the levelling means shown in FIGS. 1, 2 and 4 remains stationary.

The carriage 85 thus returns to the original position thereof during and after the lowering of frame 69 similar to the case in FIGS. 1, 2 and 4.

On the other hand in the embodiment as shown in FIGS. 1, 2 and 4, scraping or wiping means could also cooperate with glass plates 55 and 56.

It is also to be noted that to insure centering of trays 68 on conveyor 5, guides 80 are provided on either side of said trays from the press at least down to the outlet of the levelling means.

A brush and possibly even a movable platen might be provided between the press and the metering device to remove the burrs which might be formed on the blocks as they are manufactured in the press.

The preferred embodiment which lies in adjusting the height of the blocks before hardening thereof, is essentially based on limiting the variations in the moisture contents of the material, such as concrete which is used to manufacture said blocks, below 10%. Consequently the relative variations in the shrinking as the blocks dry-up will be at the most about 0.1%, which can be considered as to be neglected.

It must be understood that the invention is in no way limited to the above embodiments and that many changes can be brought therein without departing from the scope of the invention as defined by the appended claims.

For instance even if the retaining of the levelling member at a fixed level is a main feature of a preferred embodiment of the invention, it would be possible in some cases to provide a member which is movable in the height to be applied on the blocks.

On the other hand even when the adjusting of not yet hardened blocks is also an essential feature of a preferred embodiment of the method according to the invention, it is possible in some cases to provide the adjusting of the hardened blocks, possibly after surface-treating same with a product which insures the adhesion on said blocks of the material used.

It would moreover be possible to adjust in the height blocks, for instance plain blocks to be assembled by glueing. In this case according to the invention, and uniform layer of said material could be spread over the whole top surface of the blocks.

Instead of using pure cement, it might be possible to lay over the blocks a thermosetting material which would for example react under the action of heat from the levelling member as it is engaged by same.

I claim:

1. Method for adjusting to a predetermined height building blocks and similar, notably hollow concrete blocks to be laid dry upon one another and to be filled with a binder, said blocks having been formed in a mold with an actual height which is less than said predetermined height and then unmoulded, which method comprises laying over the top sides of the unmolded blocks forming the top edges of the block sidewalls upon which superimposed blocks bear in a block wall construction an amount of a substantially dry material which is hardenable and bindable thereon responsive to moisture with a height which is higher than the difference between said predetermined height and the actual height of the block under consideration, thereafter leveling said material over said block sides before hardening thereof until the total block height formed by the sum of said formed block height and said material height substantially corresponds to said predetermined height, said material being unconfined by any mold, both during the laying and the leveling, and adding moisture to said dry material to at least partly harden and bind said material to said blocks.

2. Method as defined in claim 1, which further comprises using as material which is hardenable and bindable on said blocks, a powdered product which is hardenable under the action of moisture.

3. Method as defined in claim 2, in which said powdered product is a cement-base product.

4. Method as defined in claim 3, in which said powdered product is essentially comprised of pure cement.

5. Method as defined in claim 1, which further comprises laying said powdered material over the blocks so soon after moulding of the blocks proper that they have not yet dried, so that said material can harden and bind to said blocks at least partly under the action of moisture contained in the blocks proper.

6. Method as defined in claim 5, which further comprises laying said material over said blocks after moulding and before subjecting said blocks to a drying operation.

7. Method as defined in claim 1, in which an amount of said material having a temperature which is higher than the room temperature is laid over the blocks and said material is levelled by means of a member that surface of which engaging said material has a temperature which is at least in the range of the temperature of that material laid over said blocks.

8. Method as defined in claim 7, in which the material is heated before laying same over the blocks.

9. Method as defined in claim 7, which further comprises laying over the blocks an amount of material the temperature of which lies between 30° and 60° C.

10. Method as defined in claim 9, which further comprises laying over the blocks an amount of material the temperature of which is about 40° C.

11. Method as defined in claim 10, in which the contact surface of said member is retained at a temperature of at least about 70° C.

12. Method as defined in claim 1, in which said material is levelled by means of a roller which is caused to roll without sliding above said blocks, at said predetermined height.

13. Method as defined in claim 1, in which on the top sides of each block are formed at least four small heaps from said material, so distributed as to form a stable base for the laying of said blocks, said heaps then being levelled to have the total height of the block concerned substantially correspond to said predetermined height.

14. Method as defined in claim 1, which further comprises first forming inside a mould blocks the height of which varies between said predetermined height and a height lower than said predetermined height, laying over the blocks not yet hardened and still moist, an amount from said material the height of which is higher than the difference between said predetermined height and the actual height of the block considered, levelling said material amount to have the block total height formed by the sum of the actual block height and the material amount height, substantially correspond to said predetermined height, and subjecting said blocks adjusted in the height, to a drying and hardening operation.

15. Method as defined in claim 14, which comprises first forming inside a mould, blocks the height of which is lower at the most by 5 mm than said predetermined height, and laying over said blocks an amount from said material the height of which is such that the total height of the block under consideration is higher by 5 mm at the most than said predetermined height.

16. Method as defined in claim 14, wherein the face of each block opposite that face on which the material is laid is supported at a distance equal to said predetermined height below the level at which the levelling of the material is performed, and performing said levelling while the block is so supported.

17. Method as defined in claim 1, in which said material is laid over the blocks as said blocks are moved with a substantially constant speed, along a substantially horizontal direction.

18. Method as defined in claim 1, in which the top side of said blocks is brushed before laying said material thereon.

19. Method as defined in claim 1, in which the burrs formed on said blocks are removed at least partly before laying said material thereon.

20. Method as defined in claim 1, wherein the adjusting is performed without impacts transferred to the blocks.

21. Method as defined in claim 1, wherein the powdered material is laid only on the top sides of the blocks.

22. Method of adjusting to a predetermined height building blocks to be laid dry upon one another in use, which method comprises forming blocks in a mold with an actual height which is less than said predetermined height, removing the formed blocks from said mold while still containing moisture, and thereafter laying over top side portions of the blocks while still containing said moisture, an amount of a dry powdered material which will harden and bond thereto at least partly in response to the moisture contained in said blocks, with a height which is higher than the difference between said predetermined height and the actual height of the formed block, and thereafter leveling said material before complete hardening thereof, until the total height formed by the sum of said block height and said material height substantially corresponds to said predetermined height, wherein said material is unconfined by any mold, both during said laying and said leveling, and wherein the top sides of said blocks are capable of receiving other of said blocks of predetermined height laid dry one upon the other.

23. Method as defined in claim 1, in which that material amount laid over the blocks is additionally moistened.

24. Method as defined in claim 23, in which said material amount laid over said blocks is moistened after levelling thereof.

25. Method as defined in claim 23, in which the blocks provided with said material are fed through a water mist.

26. Method of adjusting to a predetermined height building and similar blocks which are to be laid dry upon one another in use, the method comprising a. forming blocks in a mold with an actual height which is less than said predetermined height and having moisture therein at least in the region of the top sides thereof, b. laying over the top sides of the formed blocks, while still containing said moisture, a predetermined amount of a dry powdered material which will harden and bond thereto at least partly in response to said moisture and to a height which is higher than the difference between said predetermined height and the actual height of said formed blocks, and c. thereafter leveling said material before complete hardening thereof until the height of the formed block and the material substantially corresponds to said predetermined height, wherein siad formed blocks are removed from their mold prior to said laying, and wherein said material and said formed blocks are unconfined by any mold during both said laying and said leveling.

* * * * *